US008650806B1

(12) United States Patent
Condie

(10) Patent No.: US 8,650,806 B1
(45) Date of Patent: Feb. 18, 2014

(54) HARD-SIDED EXPANDABLE SHELTER

(71) Applicant: Berg Companies, Inc., Spokane, WA (US)

(72) Inventor: Brent Condie, Worley, ID (US)

(73) Assignee: Berg Companies, Inc., Spokane, WA (US)

( * ) Notice: Subject to any disclaimer, the term of this patent is extended or adjusted under 35 U.S.C. 154(b) by 0 days.

(21) Appl. No.: 13/841,657

(22) Filed: Mar. 15, 2013

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |

(52) U.S. Cl.
USPC ..... 52/79.5

(58) Field of Classification Search
USPC ..... 52/64, 68, 69, 79.5
See application file for complete search history.

(56) References Cited

U.S. PATENT DOCUMENTS

| | | | | |
|---|---|---|---|---|
| 6,712,414 | B2 * | 3/2004 | Morrow | 296/26.01 |
| 6,772,563 | B2 * | 8/2004 | Kuhn | 52/67 |
| 7,290,372 | B2 * | 11/2007 | Aust et al. | 52/67 |
| 7,418,802 | B2 * | 9/2008 | Sarine et al. | 52/79.5 |
| 7,726,496 | B2 * | 6/2010 | Heinrichs et al. | 211/191 |
| 7,828,367 | B2 * | 11/2010 | Hickam et al. | 296/156 |
| 7,874,107 | B1 * | 1/2011 | Medley et al. | 52/79.5 |
| 7,882,659 | B2 * | 2/2011 | Gyory et al. | 52/79.5 |
| 7,930,857 | B2 * | 4/2011 | Pope | 52/67 |
| 7,966,775 | B2 * | 6/2011 | Medley | 52/79.5 |
| 2006/0185262 | A1 * | 8/2006 | Abler | 52/64 |
| 2009/0217600 | A1 * | 9/2009 | De Azambuja | 52/79.5 |
| 2010/0024315 | A1 * | 2/2010 | Pope | 52/67 |
| 2010/0064599 | A1 * | 3/2010 | Yang et al. | 52/79.5 |
| 2010/0269419 | A1 * | 10/2010 | Gyory et al. | 52/79.5 |
| 2012/0042607 | A1 * | 2/2012 | Chauncey | 52/745.21 |
| 2012/0151851 | A1 * | 6/2012 | Cantin et al. | 52/79.5 |

OTHER PUBLICATIONS

AAR Corp, Mobility Systems, "Speed. Mobility. Flexibility. The triple play of success." retrieved on Apr. 24, 2013 at <<http://www.aarcorp.com/gov/gov_3_1.htm>> 2 pages.
Gichner, Expandable Shelters, retrieved on Apr. 24, 2013 at <<http://www.gichner.us/expandable_shelters.html>> 2 pages.
Vantem Modular, The World's Most Compact Foldable Building, retrieved on Apr. 24, 2013 at <<http://www.vantemmodular.com/>> 1 page.

* cited by examiner

*Primary Examiner* — Brian Glessner
*Assistant Examiner* — Paola Agudelo
(74) *Attorney, Agent, or Firm* — Lee & Hayes, PLLC

(57) ABSTRACT

A thermally isolated portable expandable shelter may include a frame substantially similar in configuration to a shipping container and a movable portion comprising a plurality of rigid panels. The shelter may be movable between a stowed state and a fixed state, wherein the plurality of panels is folded into the frame in the stowed state and fold out during deployment. In some embodiments the plurality of panels may comprise structural insulated panels so that an interior defined by the expandable shelter is thermally isolated from an exterior. The portable expandable shelter may have reduced installation time, improved strength in both the stowed and deployed states, and reduced energy requirements.

22 Claims, 16 Drawing Sheets

HARD-SIDED EXPANDABLE SHELTER

BACKGROUND

Various portable shelters have been developed for transportation to a remote site and then set up for use at that site. Field offices, field hospitals, barracks, kitchens, mess halls, command posts, disaster relief shelters, decontamination stations, holding cells, communication centers, laboratories, and schools are some applications that may employ portable shelters. When portable shelters are no longer needed, they can be reconfigured in a way that may make them more suitable for transportation to another location. Due to their design and construction however, at least some of these portable shelters may require a significant amount of time and labor in order to be properly setup for use, and to reconfigure the portable shelter for transportation when the shelter is no longer needed. At least some of these portable shelters may include various ancillary components that must be assembled and/or installed to enable set up of the portable shelter, and disassembled when the shelter is being prepared for transportation. This can increase the time and personnel required for setup.

When deployed in extreme environments (e.g., deserts, the arctic, etc.), the portable shelters require power for equipment, such as climate control equipment, communications equipment, kitchen equipment, and security equipment. These power requirements must be met with power generators, solar panels, and/or battery systems which can be expensive to manufacture and ship.

BRIEF DESCRIPTION OF THE DRAWINGS

The following is a brief description of the appended drawings. These drawings disclose example embodiments and are therefore not to be considered limiting. The example embodiments will be described and explained with additional specificity and detail through the use of the accompanying drawings in which.

DETAILED DESCRIPTION

Overview

Figure 1:
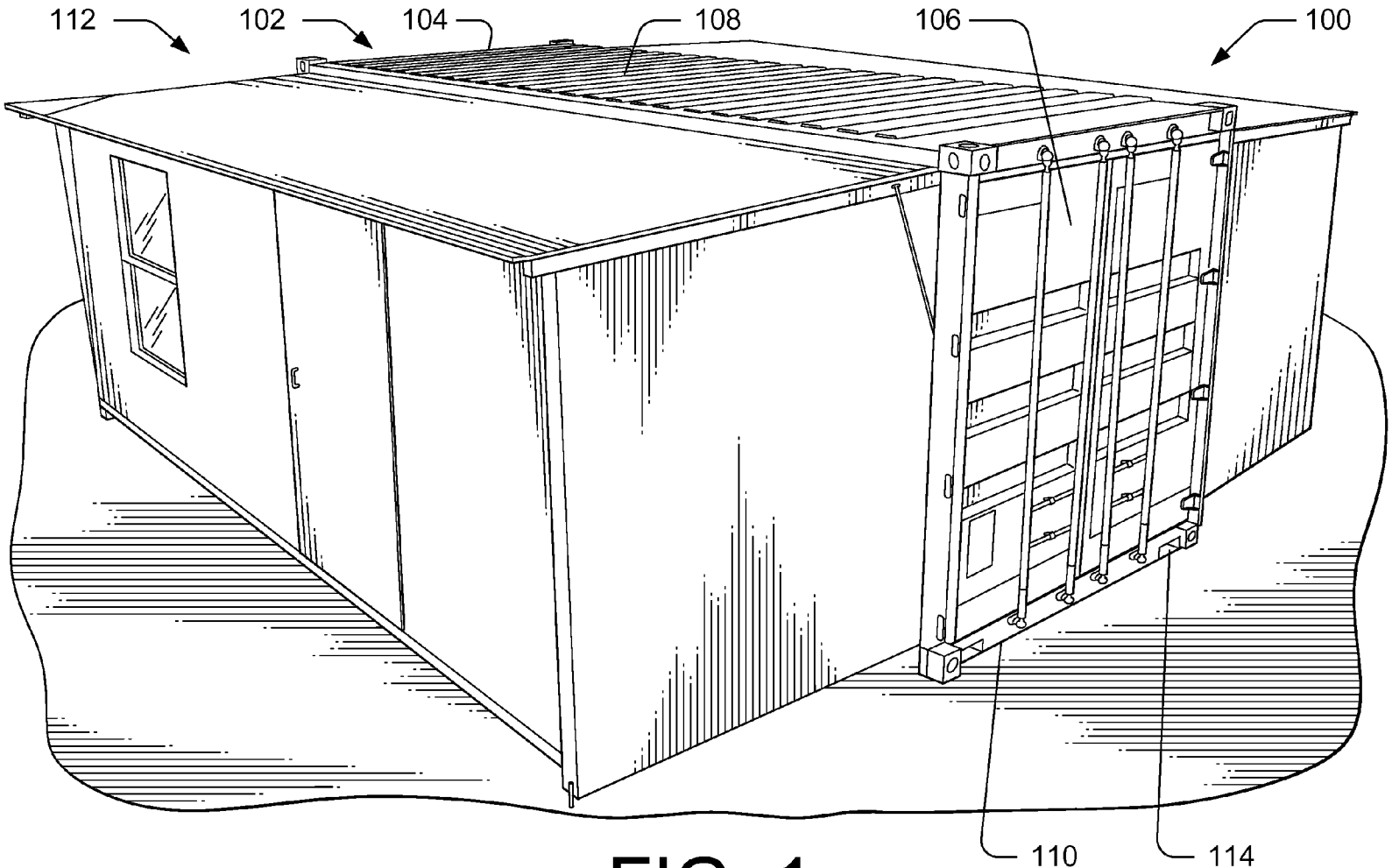
FIG. 1 is an isometric view of an example portable expandable shelter which is fast and easy to deploy and break down, is structurally robust, and has an interior that is thermally isolated from an exterior.

As discussed above, conventional portable expandable shelters take considerable time and personnel to setup. When deployed in a harsh environment, such as a desert, speed and simplicity of deployment may be a highly valued feature of a portable expandable shelter. Portable expandable shelters also may require ample power to achieve the desired functionality of the ancillary components installed within and so may be deployed with power generators, backup battery banks and/or other mobile power distribution systems. Due to the remoteness and harshness of some environments into which a portable expandable shelter may be deployed, it may be beneficial for a portable expandable shelter to require a minimal amount of power to achieve functionality in order to curtail the amount of additional power distribution systems that need deployment. For instance, considerable power is required to meet the heating ventilation and air conditioning (HVAC) needs of existing portable expandable shelters. Even the most well insulated of existing portable expandable shelters typically include one or more thermal conductors (e.g., bolts, rivets, supports, trusses, etc.) that extend from an exterior of the shelter to an interior of the shelter. Such thermal conductors are often required to provide the needed structural support or integrity of the portable expandable shelter. However, these thermal conductors provide a conducting path between the interior and exterior, greatly diminishing the thermal insulation properties of the shelter.

This application describes a portable expandable shelter having reduced installation time, improved strength in both the stowed and deployed states, and reduced energy requirements. One example embodiment employs a frame having outer dimensions and features substantially similar in configuration to an ISO shipping container and including a movable portion. The movable portion may comprise a plurality of panels that may be folded into the frame during stowage and unfolded during deployment. By utilizing a hard-sided panel system for the movable portion, the shelter can be deployed quickly and with considerable strength and insulating properties. The panels may comprise structural insulated panels (SIPs) which, in some embodiments, comprise at least a layer of insulation material sandwiched between two thin outer skins made of structural materials. By using panels with both rigid structural characteristics and improved insulation properties to comprise the movable portion, the shelter may be made structurally robust and thermally insulated.

In some examples, portable expandable shelters may include a movable portion comprising an insulated ceiling panel that may fold up (e.g., with the assistance of a fluid actuated cylinder) to a position coplanar with the top of the portable expandable shelter frame. Also included in this embodiment are two side wall panels that may fold out to become coplanar with the ends of the frame. The side walls, in the deployed state, may act as trusses to support the ceiling panel, providing structural support while extending the space enclosed by the expandable shelter. A floor panel may be included which folds down to a position coplanar with the bottom of the frame, employing a winch and cable system to ease the lowering of the floor panel. A back wall panel may also be included that folds up from the floor panel, pivoting on the floor panel outer edge to which the back wall panel bottom edge is coupled. Once fully deployed, the back wall panel may provide truss support similar to that of the side wall panels discussed above. Because of this support structure, the expandable shelter is rigid and, in some embodiments, may not need any external supports to maintain the floor panel in a substantially horizontal position. Some embodiments may include a latch and slide bolt system to secure the panels in place once deployed, reducing the tools required for installation. In some embodiments, the panels may comprise structural insulated panels that allow for thermal isolation between the interior space of the portable expandable shelter and an exterior space. The thermal isolation may be achieved, at least in part by making the frame and movable portion such that the shelter is free of thermally conducting paths between an interior and exterior of the shelter. Some embodiments within the scope of this disclosure may include additional, or alternative, elements. Examples of several embodiments are disclosed with reference to the figures.

Multiple and varied example implementations and embodiments are described below. However, these examples are merely illustrative, and other implementations and embodiments may be used to deploy a portable expandable shelter with reduced setup time and reduced energy requirements without departing from the scope of the claims.

Example Architecture

Turning now to the figures, details are provided concerning various example embodiments. In general, the embodiments disclosed in the figures are presented by way of example. Thus, the figures should not be considered as constraining the scope of the claims in any way. The components disclosed in the figures may be combined as desired to create a portable expandable shelter having various configurations. The components disclosed in the figures may be rearranged, modified, duplicated, and/or omitted in some configurations.

With reference to FIG. 1, an example embodiment of a portable expandable shelter 100 is disclosed that includes a frame 102. The frame comprises at least a first end 104, a second end 106, a top 108, a bottom 110, and a movable portion 112 disposed between the first end 104 and the second end 106. Consistent with ISO and/or other standards, the frame 102 may include structural features such as slots 114 or other openings that enable the frame to be readily transported by forklift, crane, or helicopter, for example. One or more portions of the frame 102 may be made out of a variety of materials including one or more of metal, composites such as glass composites or carbon composites for example, fabric, plastic, wood, rubber, and fiberglass. Moreover, different portions of the frame 102 may be made of different materials and/or different combinations of materials, examples of which include the aforementioned materials. The various materials employed in the construction of the frame 102 may include both rigid and non-rigid materials.

The portable expandable shelter may be made in a wide variety of shapes and sizes. For instance, full sized freight containers of any standard size may be used for large applications. TRICON, BICON, and QUADCON configurations may be useful in certain applications in which a smaller size of those configurations, relative to a 40 foot long freight container for example, enables the portable expandable shelter 100 to be readily transported and airlifted. For example, such configurations may be well suited for remote and rugged environments that present a significant challenge to the transportation and use of a relatively larger shelter, such as a shelter whose size is comparable to a full sized freight container.

One aspect of some embodiments is that multiple portable expandable shelters can be removably connected to each other in any desired combination. That is, different portable expandable shelter configurations may be connected together to form a desired combination so that, by way of example, one combination might include a BICON connected to a QUADCON. At least some of the portable expandable shelter combinations are dimensioned so that they can be transported through container channels using standardized carriers such as trucks, ships, and rail cars. The portable expandable shelters can also be transported as individual units. This approach may be particularly desirable in some instances as the relatively small size of some of the portable expandable shelters lends a degree of flexibility in terms of the various ways in which such portable expandable shelters may be transported. At least some embodiments of the portable expandable shelters are sized and configured to be suited for transportation as air cargo by airplanes or helicopters.

Figure 2:
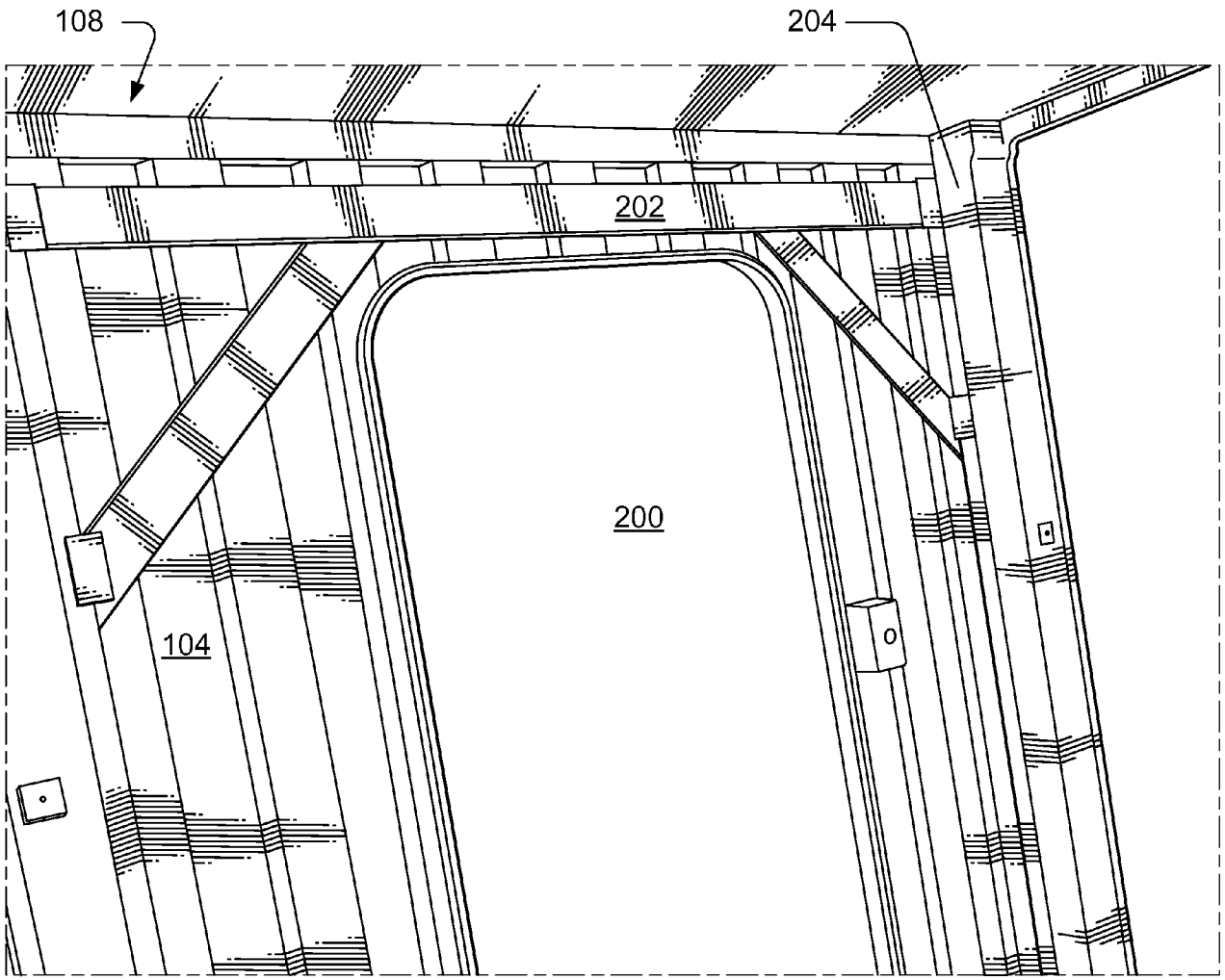
FIG. 2 is a partial perspective view of an example internal support structure of the portable expandable shelter of FIG. 1.

The disclosed embodiment of a portable expandable shelter 100 may include various structural features, as shown in FIG. 2. In some embodiments, a cut-out 200 is made to a first end 104 and/or a second end 106 of the frame. The cut-out 200 may allow for the installation of doors, windows, or corridors for linking a plurality of shelters together as discussed above. A support gusset 202 may be added to the first end 104 and/or the second end 106 of the enclosure 100, positioned around the cut-out 200. The support gusset 202 may be made out of a variety of materials including one or more of metal, such as core-ten steel, composites such as glass composites or carbon composites for example, fabric, plastic, wood, rubber, and fiberglass. Further, at least a support column 204 may be positioned substantially in at least a corner of the frame 102, extending between the top 108 and the bottom 110 of the frame 102.

Figure 3:
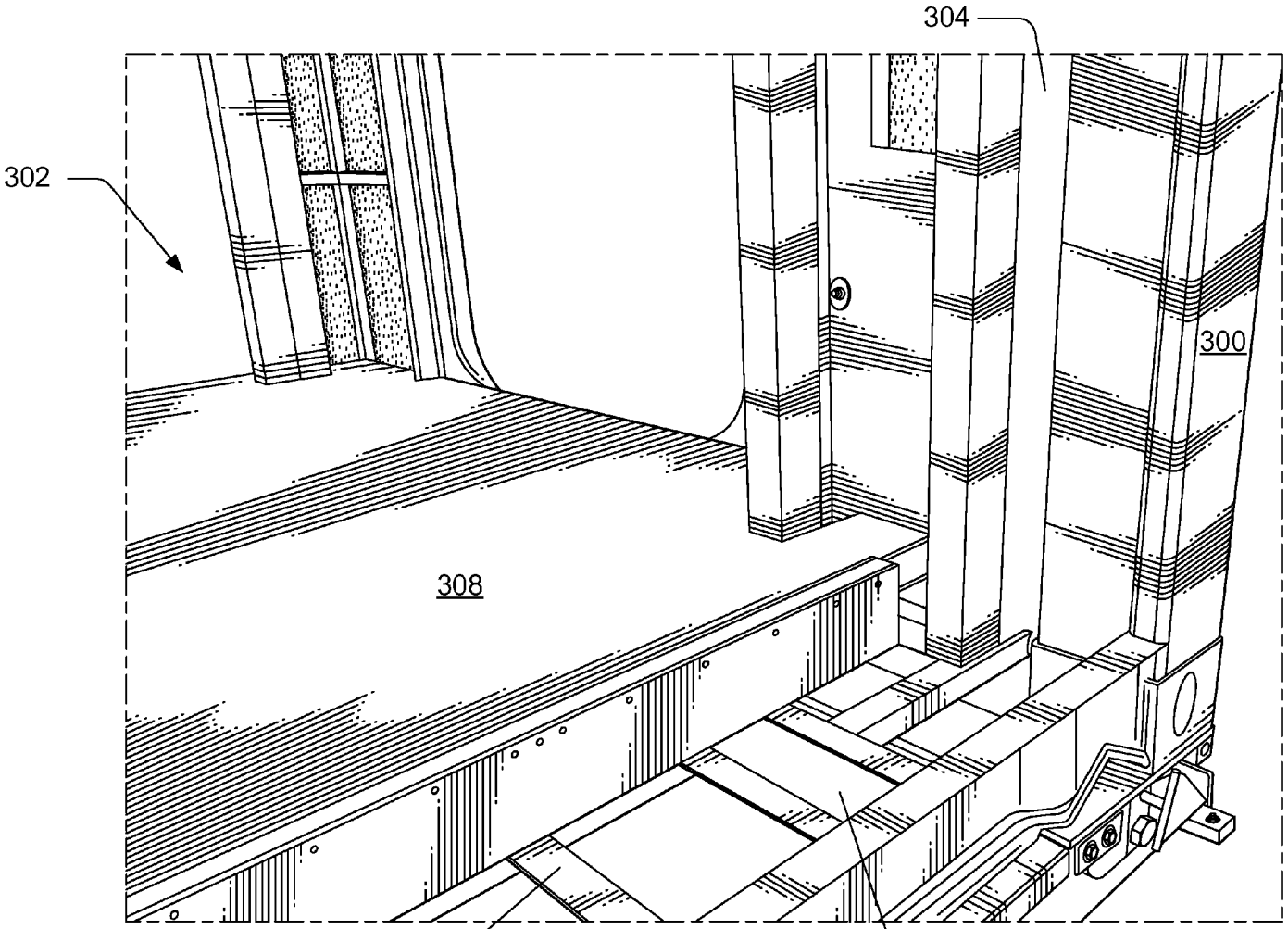
FIG. 3 is a partial perspective view of the portable expandable shelter of FIG. 1 illustrating an example inner core and an outer shell.
Figure 4:
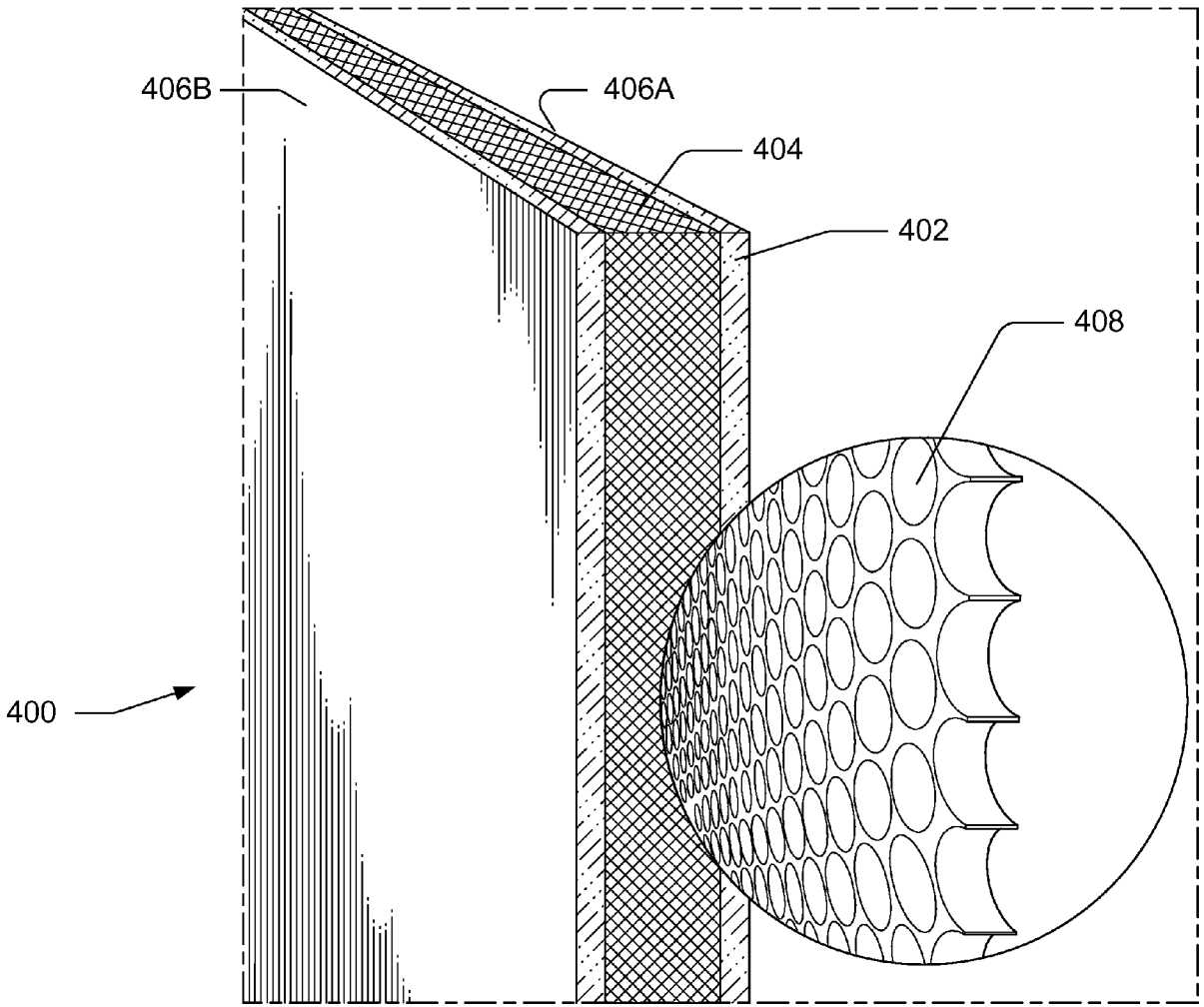
FIG. 4 is a perspective view of an example structural insulated panel usable to construct an inner core of the portable expandable shelter of FIG. 1.

In some embodiments, the frame 102 comprises both an external shell 300 and an internal core 302, as shown in FIG. 3. The shell 300 is substantially similar in configuration to the frame 102 described above in that it can comprise a first end 304, a second end (not shown), a top (not shown), and a bottom 306. The first end 304, second end, top, and bottom 306 may, in some embodiments comprise corrugated steel. In some examples, the shell 300 is a 20' ISO shipping container, but other sizes and configurations are contemplated. The core 302 may comprise an insulating material 308 that is positioned adjacent to an interior surface 310 of the shell 300. In one example, the insulating material 308 is a structural insulated panel 400, as shown in FIG. 4, and could further comprise of at least a polypropylene layer 402 and at least a polyethylene layer 404 disposed between a first fiberglass layer 406A and a second fiberglass layer 406B. The polypropylene layer 404 may comprise a substantially honeycomb shape 408. However, in some embodiments, the a structural insulated panel 400 can comprise many types of rigid polymer foam, such as expanded polystyrene foam, disposed between many types of rigid boards, such as metal, plywood, or cement. In some embodiments, a fastener may extend through the first fiberglass layer 406A and terminate in the polypropylene layer 402 or the polyethylene layer 404.

Figure 5:
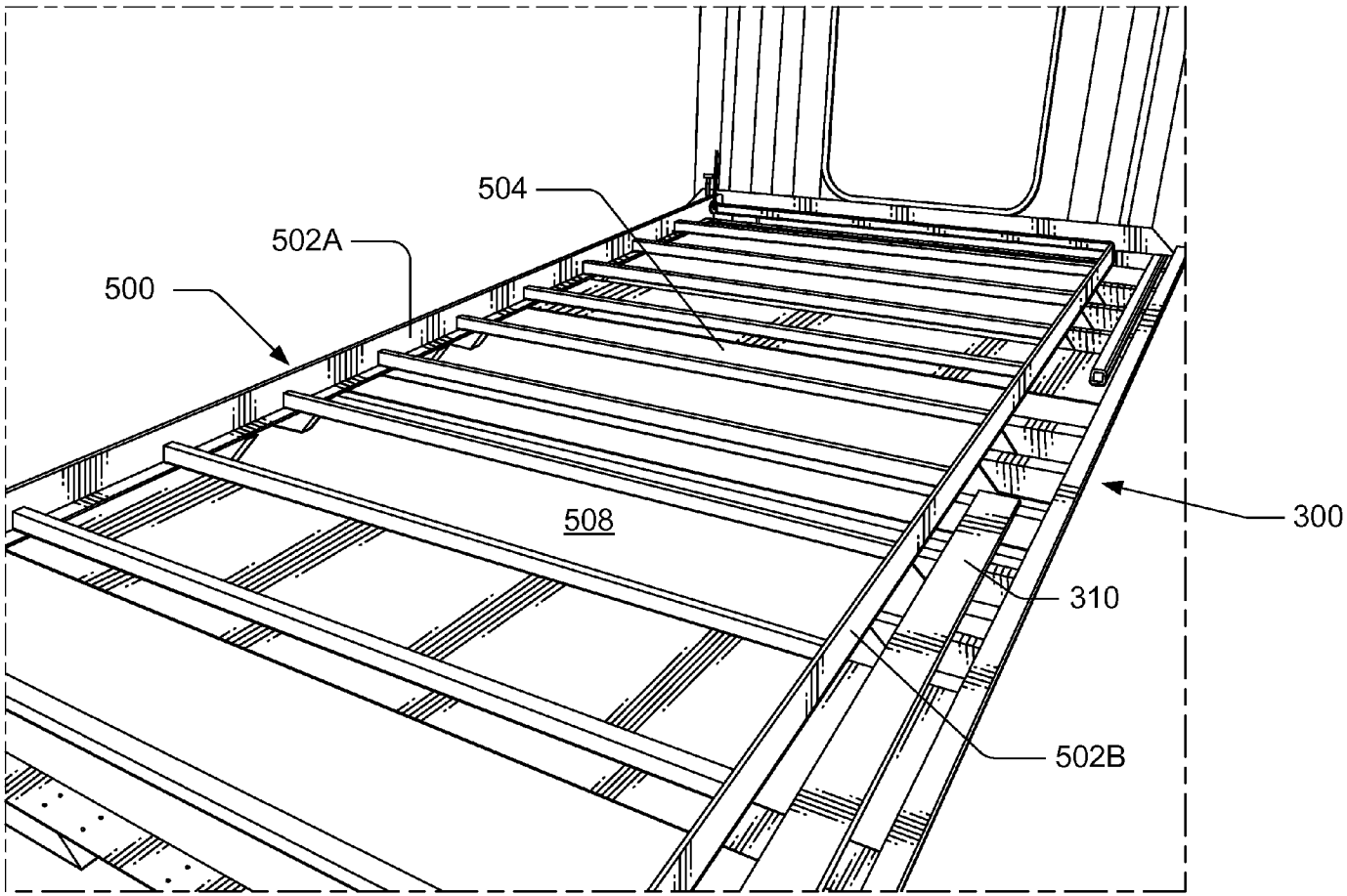
FIG. 5 is a perspective view of an example mounting rack on which the structural insulated panel of FIG. 4 may be mounted.

By way of example, the core 302 could be thermally isolated from the shell 300. In some embodiments a mounting rack 500, as shown in FIG. 5, is coupled to an interior surface 310 of the shell 300, the mounting rack 500 comprising a first lateral side rail 502A and a second lateral side rail 502B adjoined by a plurality of substantially even spaced cross bars 504. A structural insulated panel 400 is coupled to the surface 508 of the mounting rack 500 opposite the interior surface 310 of the shell 300 with fasteners (not shown). The fasteners may be bolts that couple to the under surface of the mounting rack 500 and extend partially through the structural insulated panel 400 as described above. In some embodiments, the method of fastening the structural insulated panel to the mounting rack via fasteners that extend partially through the structural insulated panel may reduce thermally conductive pathways between the core 302 and the shell 300. In some examples, the core 302 comprises a plurality of structural insulated panels 400 coupled to a plurality of mounting racks 500 which are in turn coupled to a plurality of interior surfaces 310 of the shell 300. At least a rubber seal 502 (see FIG. 8) may by aligned over a seam between at least a first and a second structural insulated panels 400, further defining a continuously insulated core 302. In some embodiments, the rubber seal 502 is an ethylene propylene diene monomer (EPDM) bulb seal.

Figure 6:
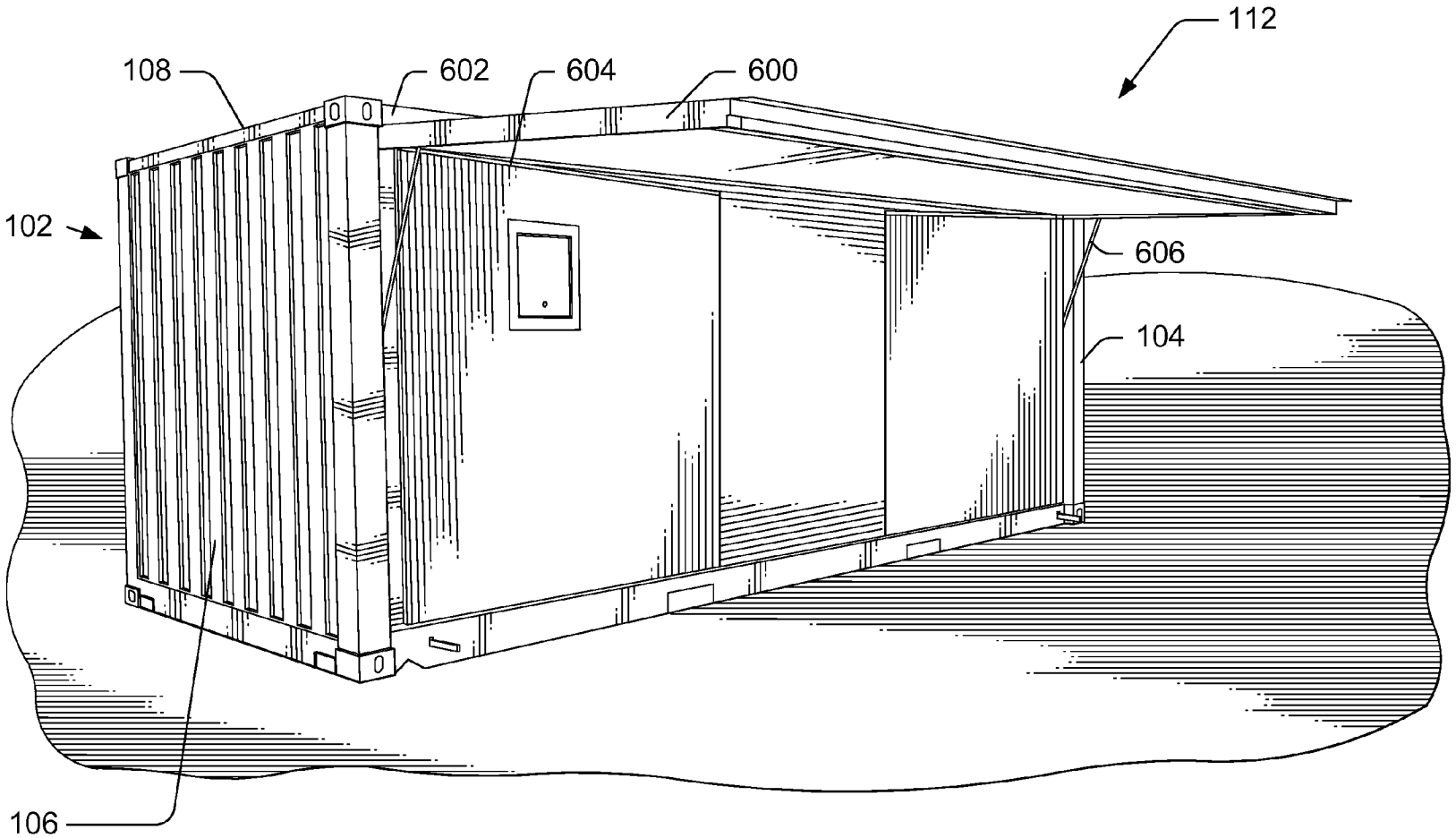
FIG. 6-11 show a sequence of views of an example portable expandable shelter as it is moved from a stowed state to a deployed state.

With reference to FIG. 6-11, an example embodiment of a movable portion 112 of portable expandable shelter 100 that can be changed between a stowed state and a deployed state is disclosed. As shown in FIG. 6, the movable portion 112 may include a ceiling panel 600 coupled to an edge 602 of the top 108 of the frame 102 via a hinge 604. When moving from a stowed state to a deployed state, as shown in FIG. 6, the ceiling panel 600 is changed from a vertical position perpendicular to and between the first and second ends 104 and 106 to a position substantially coplanar with the top 108 of the frame 102. In some examples, this motion is facilitated by a fluid actuated cylinder 606 such as a piston or a gas spring. The motion could also be facilitated by installation personnel.

Figure 7:
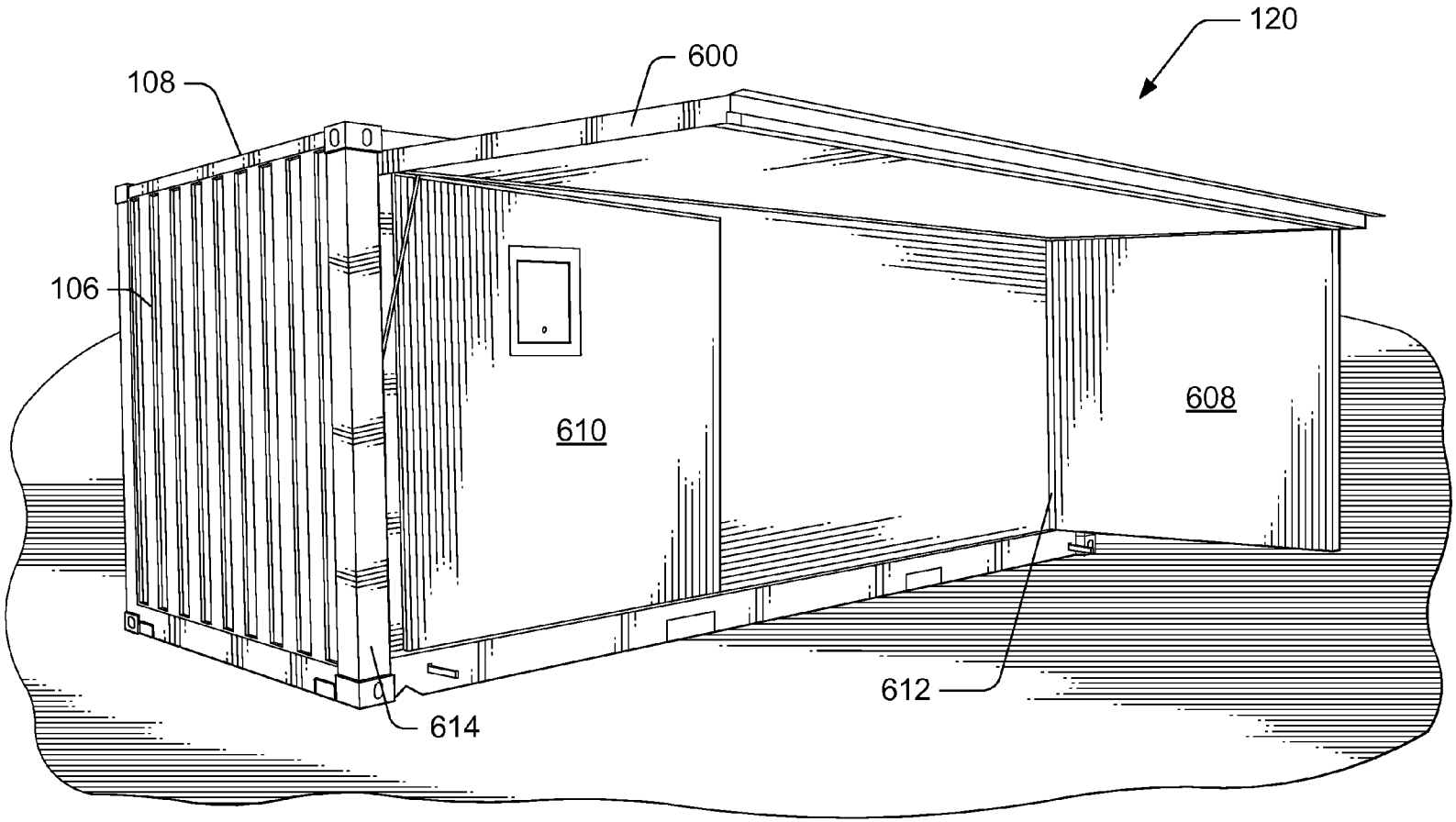
Figure 8:
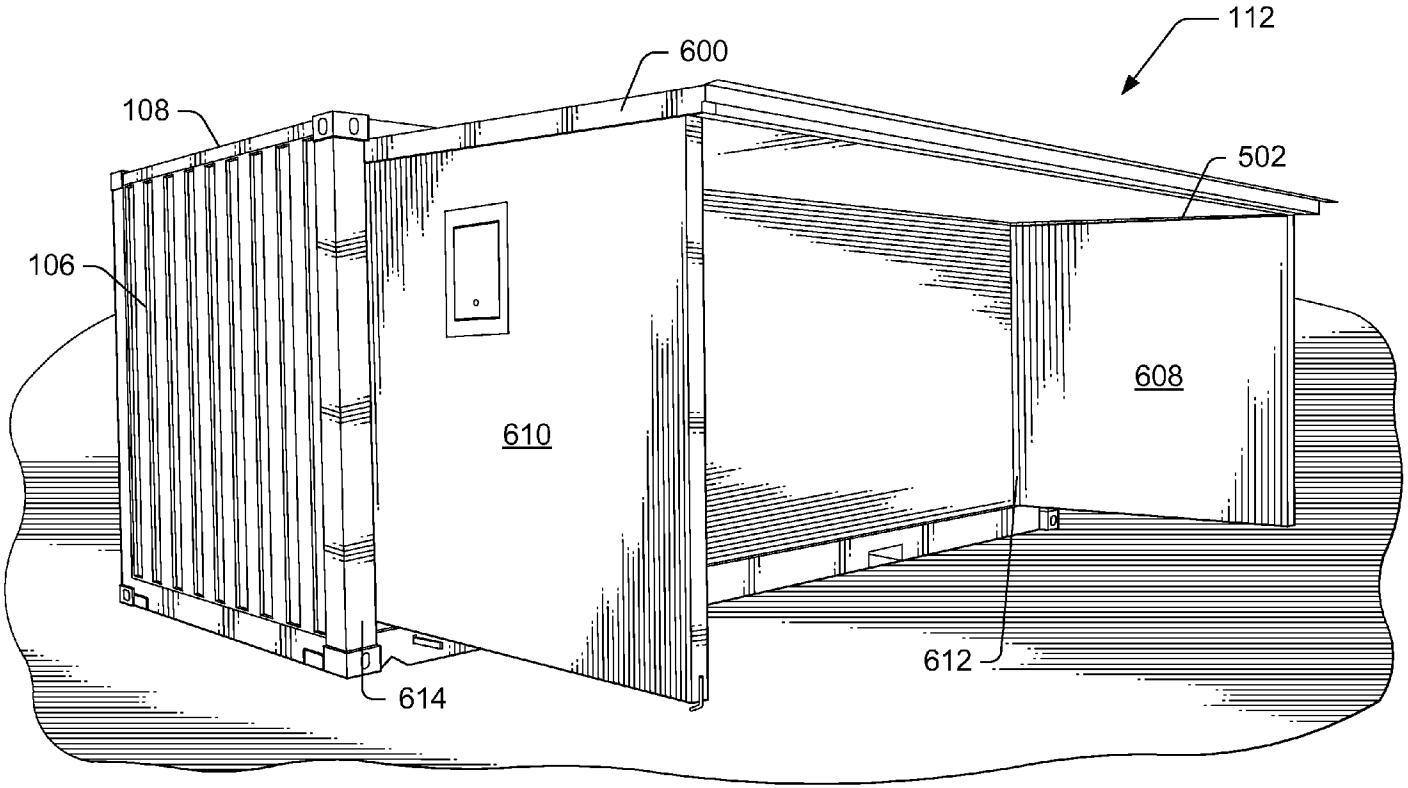

FIG. 7 and FIG. 8 disclose, by way of example, a first side wall panel 608 and a second side wall panel 610 of the movable portion 112. Upon positioning the ceiling panel 600 coplanar to the top 108, the first side wall panel 608 and the second side wall panel 610, which are coupled to a first edge 612 of the first end 104 and a second edge 614 of a second end 106, may move from a stowed state substantially perpendicular to and between the first and second ends 104 and 106 to a deployed state substantially coplanar with the first and second ends 104 and 106. In the deployed state, the first and second side wall panels 608 and 610 may act as trusses to the ceiling panel 600, providing load bearing support while sustaining the ceiling panel 600 in a substantially horizontal position.

Figure 9:
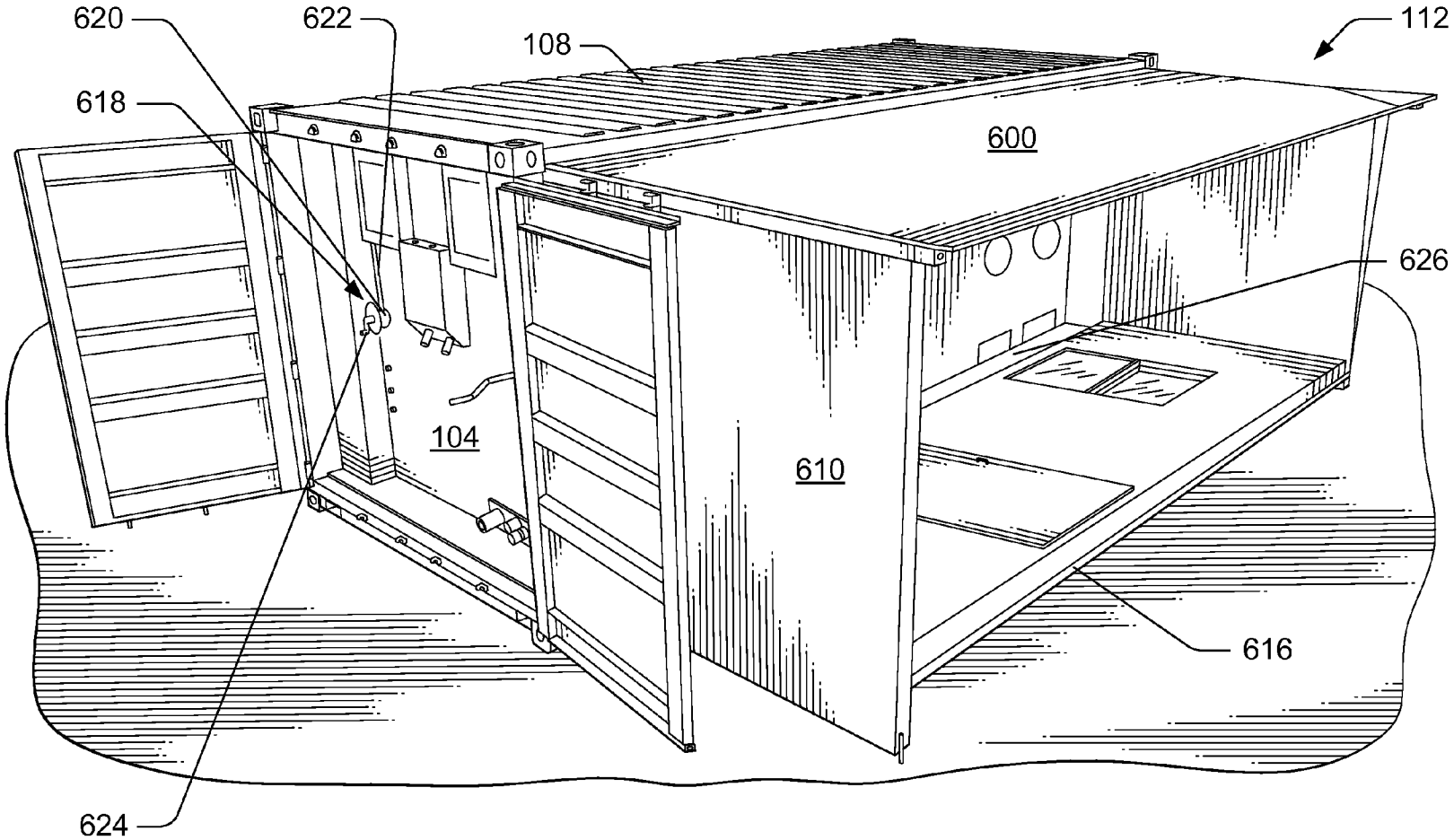

FIG. 9 discloses, by way of example, a floor panel 616 that is changed from a stowed state to a deployed state, in some embodiments, via the actuation of a winch 618. The winch 618 may be positioned on one of an end 104 or 106 of the frame 102 and may include a spool 620, a cable 622 coupled to the spool 620 and the floor panel 616, and a handle 624 that actuates motion of the spool 620. There are many other devices could be implemented for changing the tension of the cable 622.

Upon actuation of the winch 618, the floor panel 616, which is coupled to an edge 626 of the bottom 110, can move from a position substantially perpendicular to and between the first end 104 and the second end 106 to a position substantially coplanar with the bottom 110. As with the ceiling panel 600, the floor panel 616 may receive load bearing support from the first and second sidewall panels 608 and 610, which maintain the floor panel 616 in a substantially horizontal position.

Figure 10:
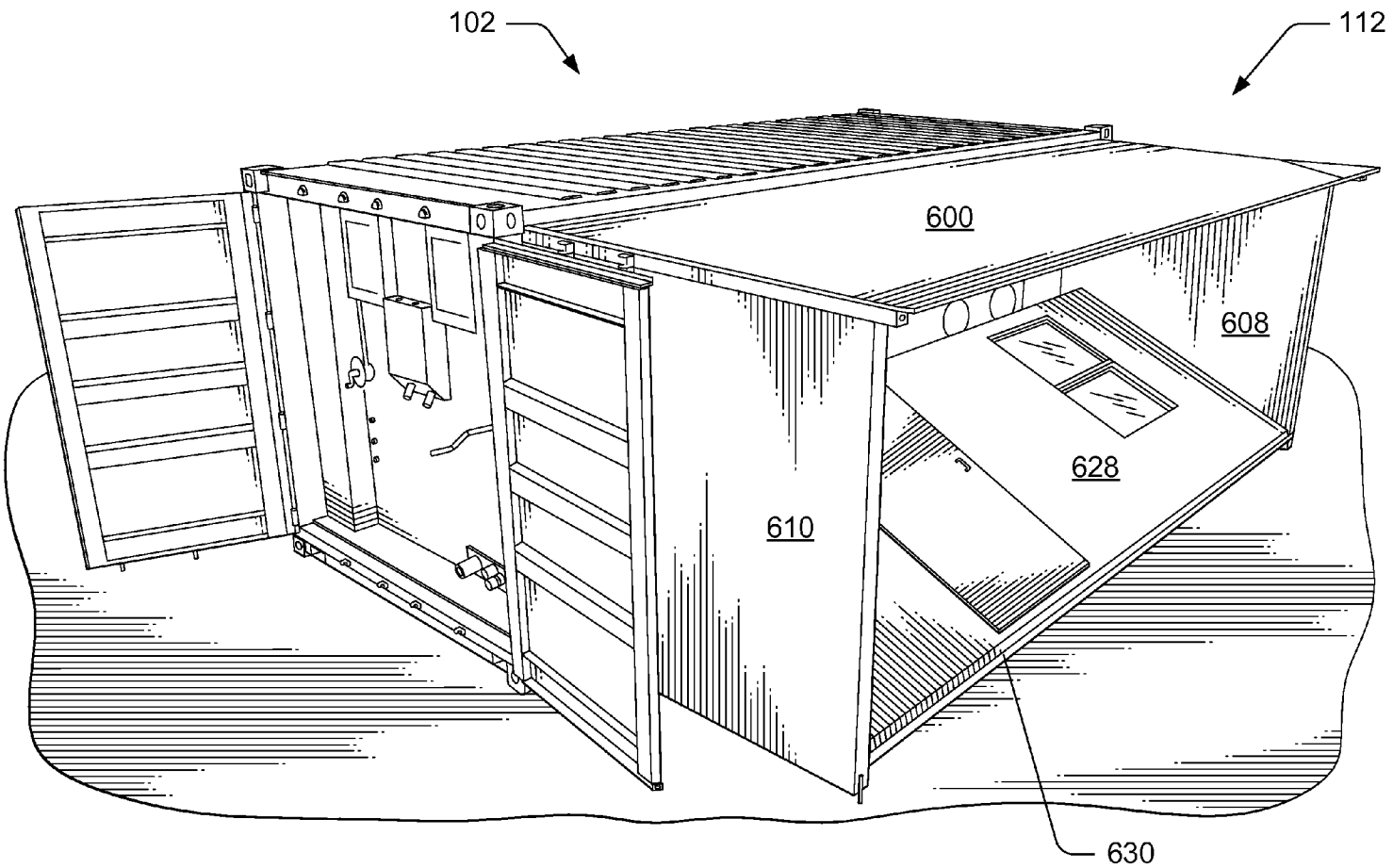
Figure 11:
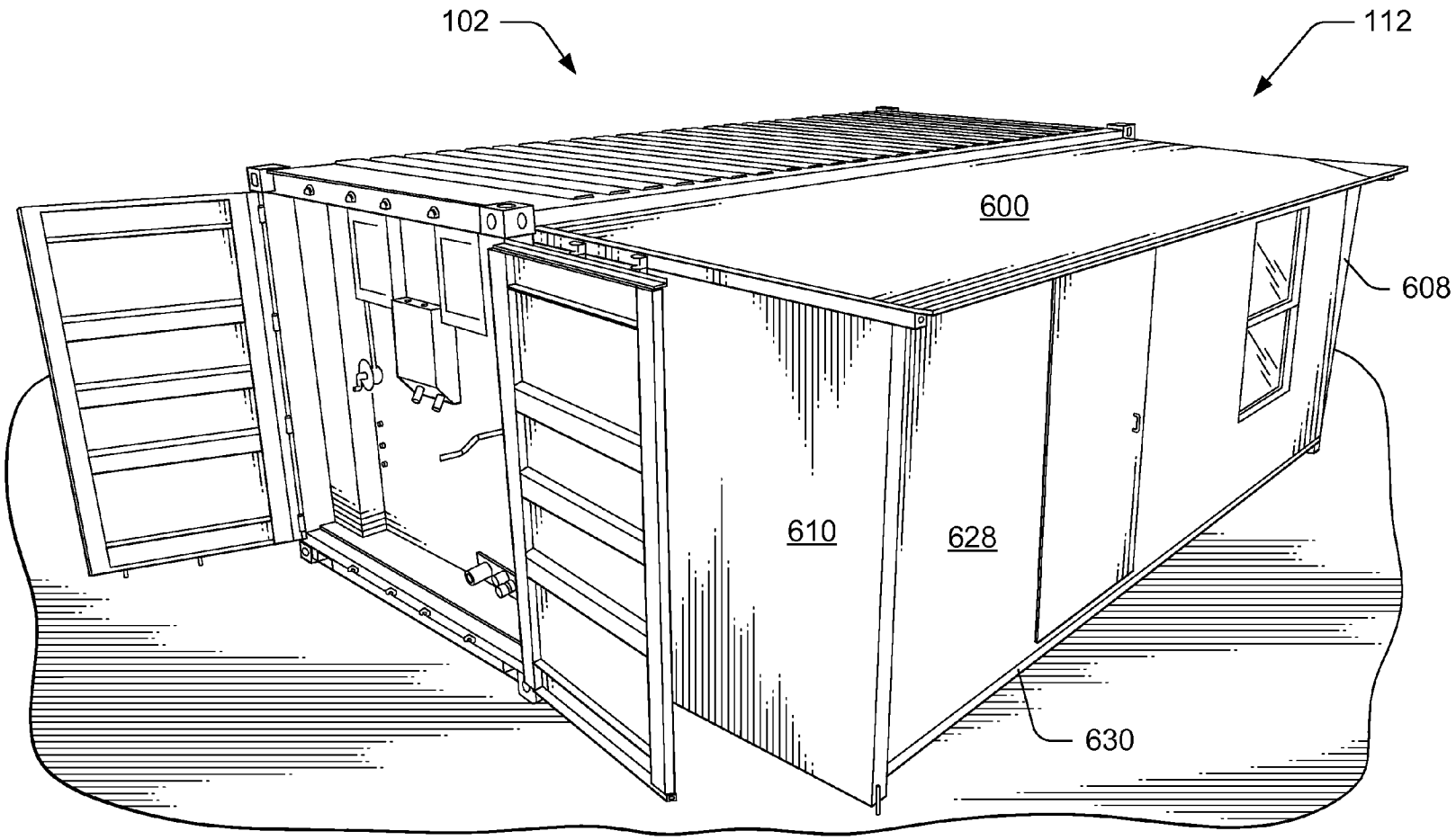

FIG. 10 and FIG. 11 disclose, by way of example, a back wall panel 628 that can move between a stowed state and a deployed state. The back wall panel 628, which is coupled to an edge 630 of the floor panel 616, may move in unison with the floor panel 616 as the floor panel 616 is moved to a substantially horizontal position. The back wall panel 628 may be moved from a position substantially coplanar with the floor panel 616 to a position substantially vertical and perpendicular to the floor panel 616, the first side wall panel 608, and the second side wall panel 610. In this position, also referred to as the deployed position, the back wall panel 628 may act as a truss providing structural support to the ceiling panel 600.

Figure 12:
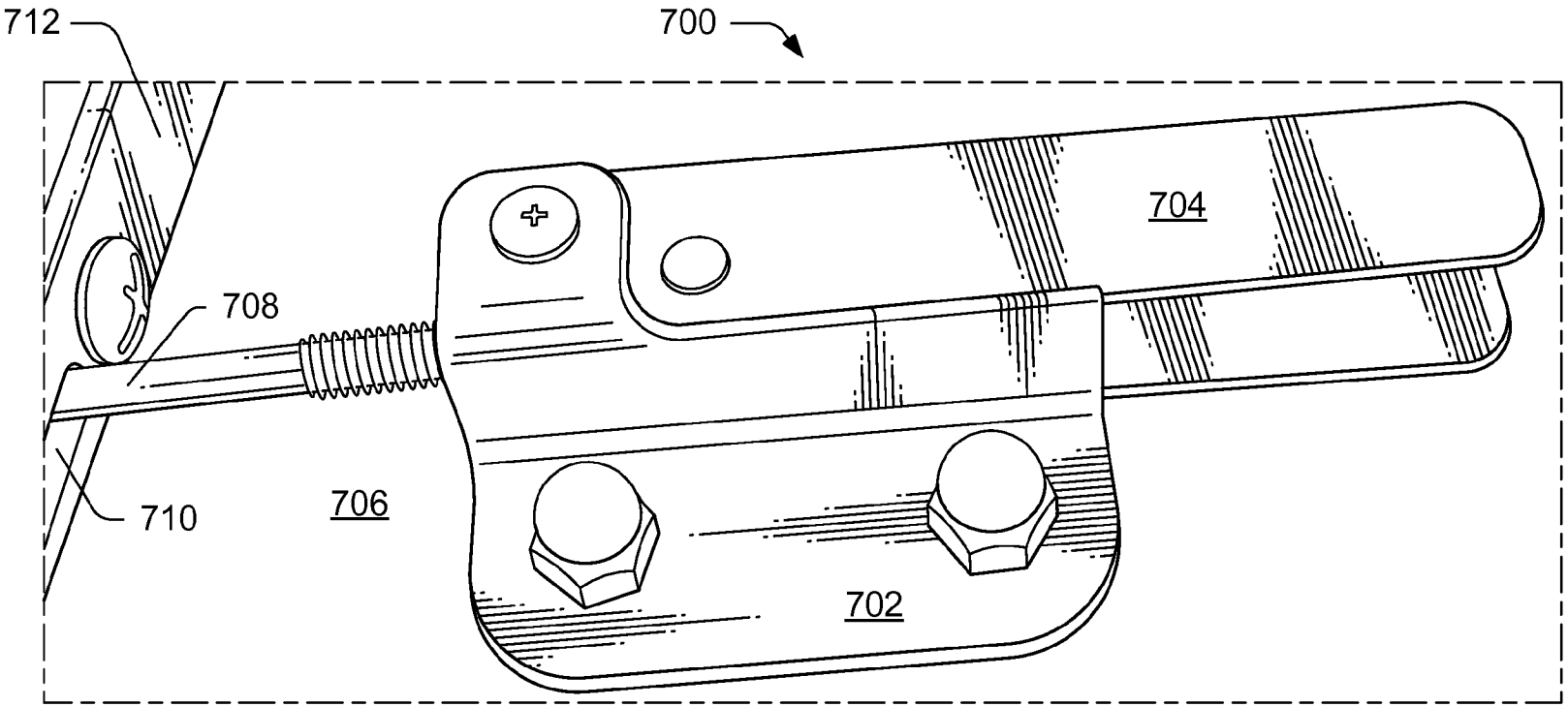
FIG. 12 illustrates an example latch that may be used to secure one or more walls of a portable expandable shelter, shown in a locked position.
Figure 13:
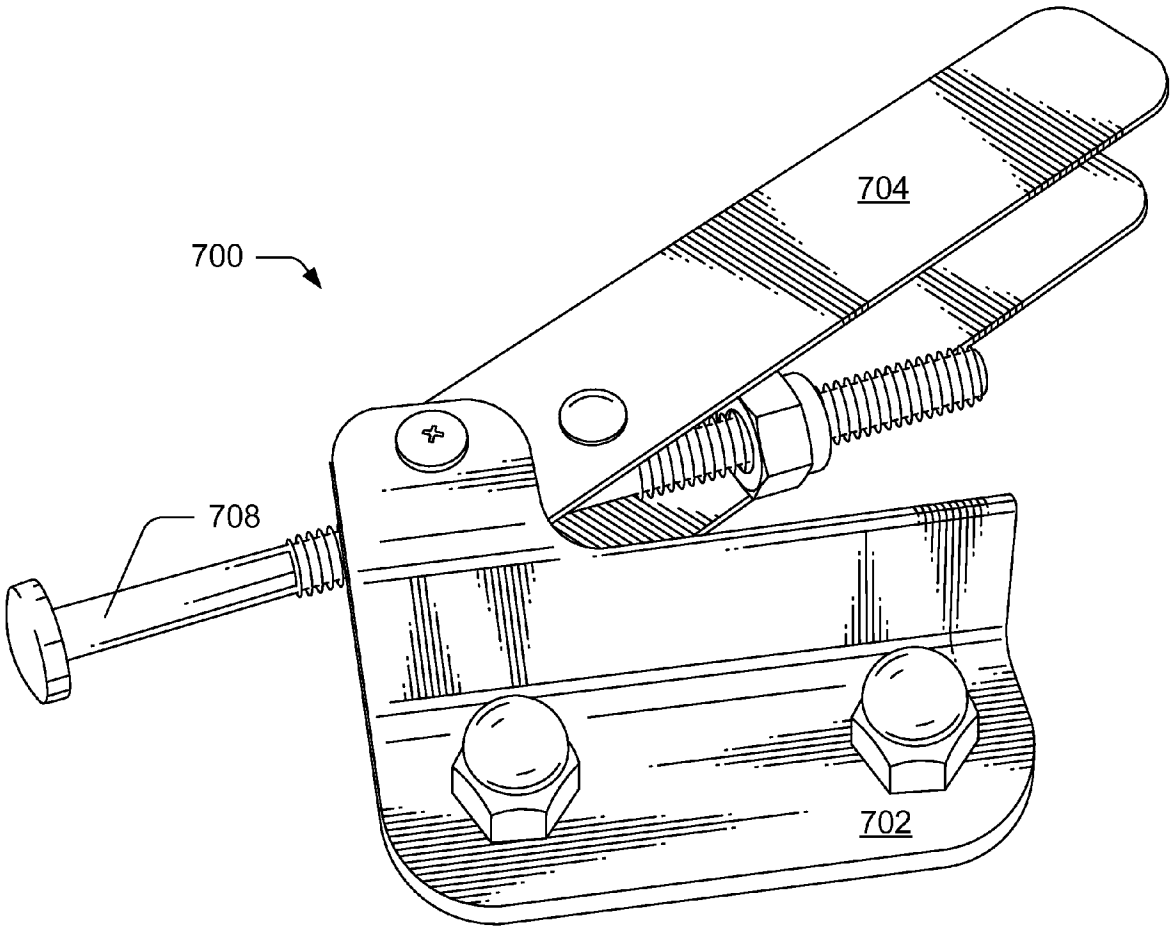
FIG. 13 illustrates the example latch of FIG. 12 in an open position.

The plurality of panels 600, 608, 610, 616, and 628 that comprise the movable portion 112 are substantially stationary when in the deployed state, facilitated in some embodiments by at least a latch 700 that connects the plurality of panels 600, 608, 610, 616, and 628 near their edges. In some examples, the latch 700, as show in FIG. 12 and FIG. 13, may include a flanged body 702 with a pivotable handle 704, the flanged body 702 being mountable to a surface 706. A slide bolt 708, interposed between the flanged body 702 and the handle 704, may be received in an aperture 710 and clamped securely tight. The aperture 710 may be positioned on the ceiling panel 600 near a ceiling panel edge 712, on the floor panel 616 near a floor panel edge (not shown), and/or on the back wall panel 628 near a back wall edge (not shown). There may be many designs and configurations of latches 700 that could be implemented to maintain the plurality panels 600, 608, 610, 616, and 628 in a static position relative to each other. There are also a variety of locations on the plurality of panels 600, 608, 610, 616, and 628 where the latches 700 could be positioned to achieve a static position relative to each other.

Figure 14:
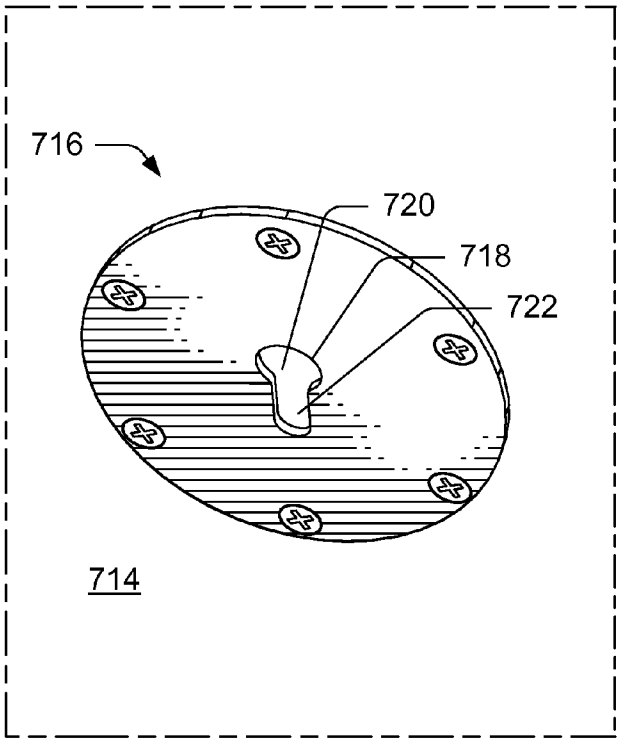
FIG. 14 is a perspective view of an example mounting hole usable to mount one or more pieces of conduit or other equipment to a portable expandable shelter.

In addition to providing truss support to the ceiling panel 600 in the deployed state, the first and second side wall panels 608 and 610 and the back wall panel 628 in some embodiments may also provide interior wall surface space 714 on which ancillary components (not shown) may be mounted. In some examples, shown in FIG. 14, a mounting hole 716 with a substantially keyhole shape 718 may be installed into the interior wall surface 714. The substantially keyhole shape 718 comprises a substantially round portion 720 combined with a slotted portion 722 that extends down from the round portion 720. The keyhole shape 718 may be well suited for quick installations of components that include a corresponding mounting protrusion that can be received by the mounting hole 716. Based on the needs the portable expandable shelter 100 was deployed to meet, various types and combinations of equipment could be installed in the mounting holes 716. By way of example and not limitation, these may include sinks, counters, beds, mirrors, desks, communication equipment, and any other equipment needed to realize the functionality of the portable expandable shelter 100.

In some embodiment, the plurality of panels 600, 608, 610, 616, and 628 that comprise the movable portion 112 are comprised of a plurality of structural insulated panels 400, as shown in FIG. 4. The structural insulated panels 400 could further comprise at least a polypropylene layer 402 and at least a polyethylene layer 404 disposed between a first fiberglass layer 406A and a second fiberglass layer 406B. In another embodiment, the structural insulated panel 400 may comprise many types of rigid polymer foam, such as expanded polystyrene foam, disposed between many types of rigid boards, such as metal, plywood, or cement.

Figure 15:
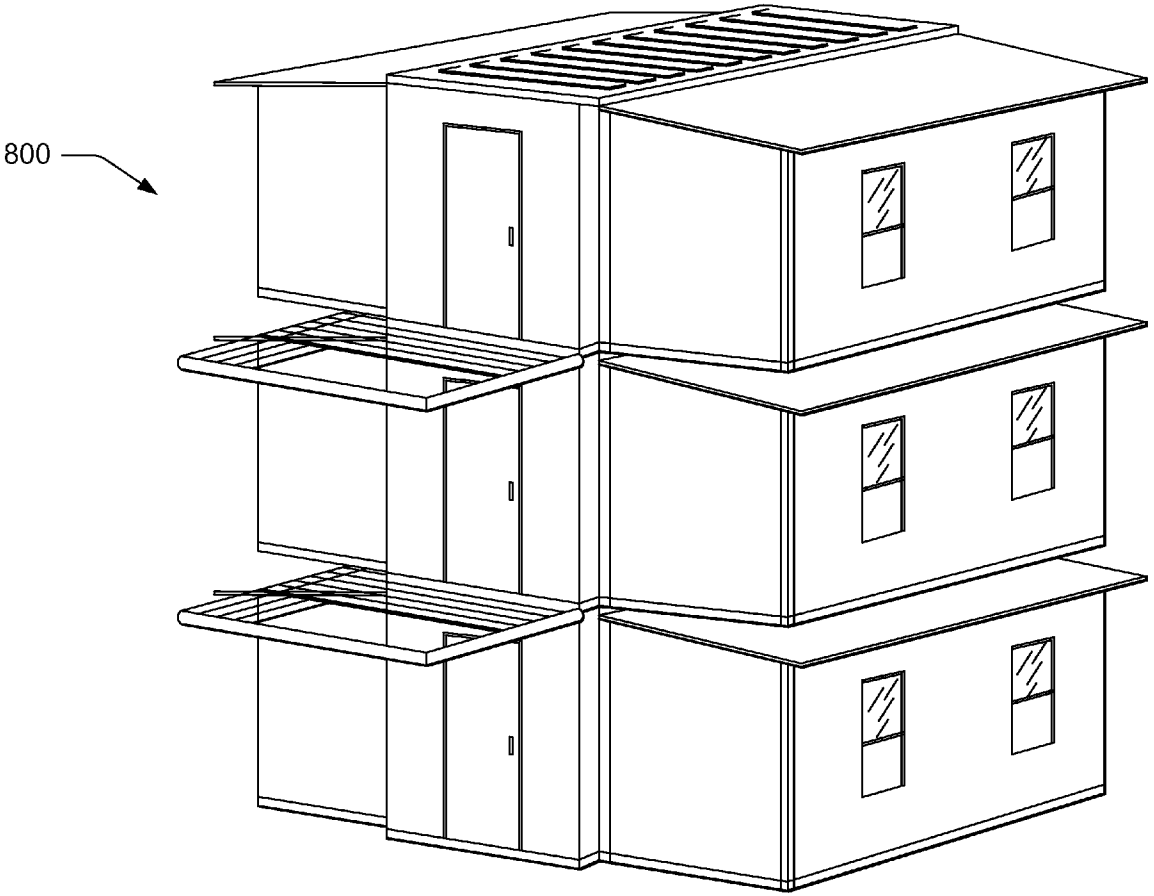
FIG. 15 is an isometric view of a plurality of portable expandable shelters stacked vertically in a deployed state.
Figure 16:
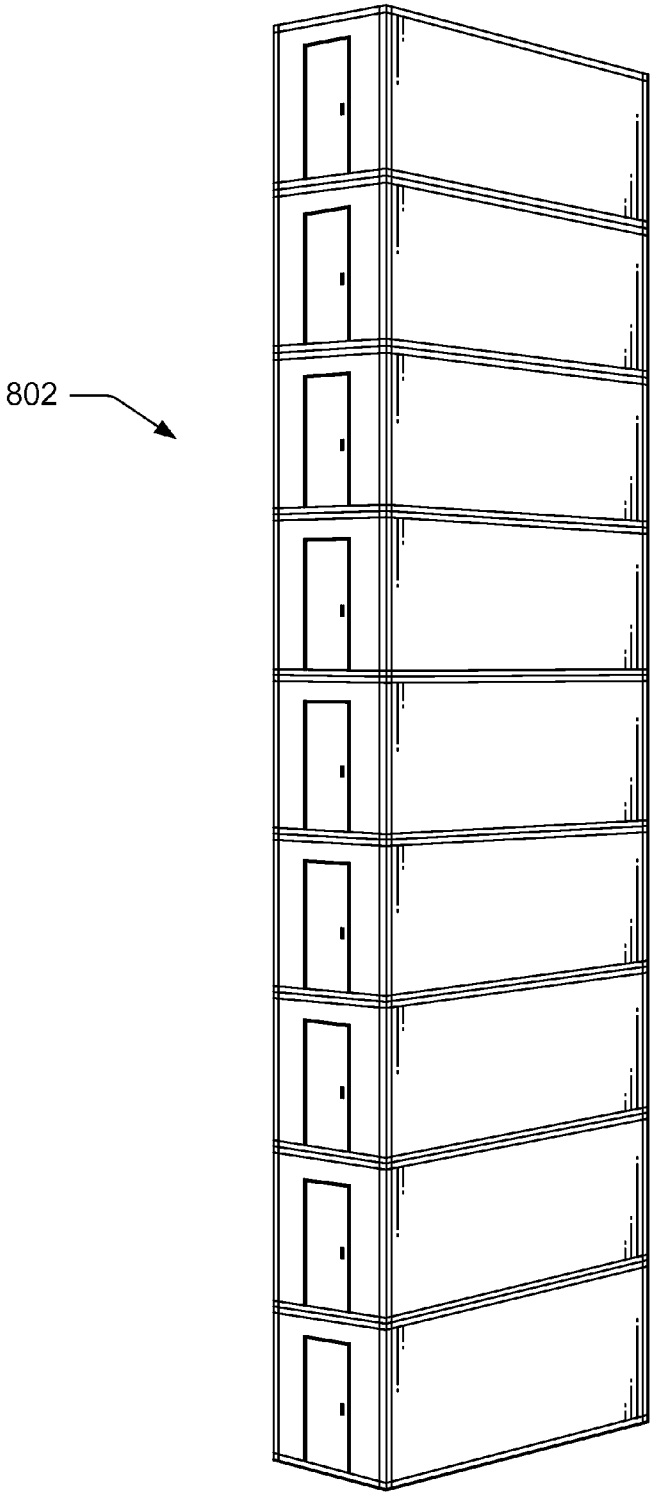
FIG. 16 is an isometric view of a plurality of portable expandable shelters stacked vertically in a stowed state.

In some embodiments, a portable expandable shelter 100 may be shipped with a plurality of other portable expandable shelters 800 with a substantially similar configuration, referring now to FIG. 15 and FIG. 16. When shipping, it is desirable for the portable expandable shelter 100 to have a reduced weight while maintaining enough structural integrity to allow for vertical stacking. In some embodiments, two portable expandable shelters 800 may be stacked on top of a portable expandable shelter 100 when the shelters 800 and 100 are in a deployed state. Also, eight portable expandable shelters 802 may be stacked on top of a portable expandable shelter 100 when the shelters 802 and 100 are in a stowed state.

All of the elements of the portable expandable shelter 100 discussed above, including the frame 102 and the movable portion 112 comprising a plurality of panels 600, 608, 610, 616, and 628, may have a combined material weight of substantially 7,200 lbs. Therefore, nine portable shelters stacked vertically in a stowed state may weigh approximately 64,800 lbs. Three portable shelters stacked vertically in a deployed state may weigh approximately 21,600 lbs.

Conclusion

Although the application describes embodiments having specific structural features and/or methodological acts, it is to be understood that the claims are not necessarily limited to the specific features or acts described. Rather, the specific features and acts are merely illustrative of some embodiments that fall within the scope of the claims of the application.

What is claimed is:

1. A portable expandable shelter comprising:

a fixed portion comprising:

a shell having a first end, a second end substantially parallel to the first end, a top, a bottom substantially parallel to the top, and a thermally insulated core comprised of a plurality of structurally insulated panels coupled to the shell with a fastener attached to the shell, extending towards an interior of the portable expandable shelter, and penetrating only an outer surface of the core such that the coupling is free of thermal transmission paths, and a movable portion interposed between the first end and the second end of the fixed portion when in a stowed state, the movable portion being movable between the stowed state and a deployed state, and the movable portion comprising:

a ceiling panel extending away from the top in the deployed state, a floor panel substantially parallel to the bottom in the deployed state, a first side wall panel substantially parallel to the first end in the deployed state, a second side wall panel substantially parallel to the second end in the deployed state, and a back wall panel substantially perpendicular to the first and second ends in the deployed state, at least one panel of the movable portion comprising a structural insulated panel.

2. The portable expandable shelter of claim 1, further comprising at least a support column interposed between the top and bottom and between the first end and second end.

3. The portable expandable shelter of claim 1, wherein the portable expandable shelter maintains structural stability when eight shelters are stacked on top of it while in the stowed state.

4. The portable expandable shelter of claim 1, wherein the portable expandable shelter maintains structural stability when two shelters are stacked on top of it while in the deployed state.

5. The portable expandable shelter of claim 1, further comprising a first seam defined by the ceiling panel and the first end, a second seam defined by the ceiling panel and the second end, a third seam defined by the ceiling panel and the back wall, a fourth seam defined by the floor panel and the first end, a fifth seam defined by the floor panel the second end, and a sixth seam defined by the floor panel and the back wall wherein at least one of a seam is covered by a rubber seal.

6. The portable expandable shelter of claim 5, wherein the seal comprises an ethylene propylene diene monomer rubber bulb seal.

7. The portable expandable shelter of claim 1, wherein the first end, second end, top, and bottom substantially correspond in shape and size to an ISO shipping container.

8. A portable expandable shelter, comprising:

a frame comprising:

a first end, a second end substantially parallel to the first end, a top, and a bottom substantially parallel to the top, wherein the first end, second end, top, and bottom define a perimeter comprising a first vertical edge, a second vertical edge, a top edge, and a bottom edge;

a thermally insulated core comprising a plurality of structurally insulated panels coupled to the frame with a fastener attached to the frame, extending towards an interior of the portable expandable shelter, and not penetrating an interior surface of the core such that the coupling is free of thermal transmission paths; and a movable portion comprising a plurality of panels, the plurality of panels being movable between a stowed state and a deployed state, the plurality of panels comprising:

a ceiling panel coupled to the top edge that is movable between a position substantially coplanar with the perimeter and a substantially horizontal position, a first side wall panel coupled to the first vertical edge that is movable between a position substantially coplanar with the perimeter and a position substantially coplanar with the first end, a second side wall panel coupled to the second vertical edge that is movable between a position substantially coplanar with perimeter and a position substantially coplanar with the second end, a floor panel coupled to the bottom edge that is movable between a position substantially coplanar with the perimeter and a substantially horizontal position, and a back wall panel coupled to the floor panel that is movable between a position substantially coplanar with the floor panel and a substantially vertical position.

9. The portable expandable shelter of claim 8, wherein the first side wall panel and the second side wall panel provide load bearing support to the ceiling panel in the deployed state.

10. The portable expandable shelter of claim 8, wherein the first side wall panel and the second side wall panel provide structural support to the floor panel in the deployed state.

11. The portable expandable shelter of claim 8, wherein the movable portion and frame enclose a space that defines the interior, the interior being thermally isolated from an exterior of the shelter.

12. The portable expandable shelter of claim 8, wherein at least a panel of the movable portion comprises a structural insulated panel.

13. The portable expandable shelter of claim 12, wherein the structural insulated panel further comprises at least a first skin, a foam core, and a second skin.

14. The portable expandable shelter of claim 8, further comprising latches for maintaining the movable portion in the deployed state.

15. The portable expandable shelter of claim 8, further comprising a gusset coupled to the frame around a cut-out, the gusset providing structural support.

16. The portable expandable shelter of claim 8, wherein the portable expandable shelter maintains structural stability when eight stowed shelters are stacked on top of it or when two deployed shelters are stacked on top of it.

17. A thermally isolated portable expandable shelter comprising:

a shell comprising a first end, a second end substantially parallel to the first end, a top, and a bottom substantially parallel to the top, a core comprising a structural insulated panel that defines a first side wall, a structural insulated panel that defines a second side wall substantially parallel to the first side wall, a structural insulated panel that defines a ceiling, and a structural insulated panel that defines a floor substantially parallel to the ceiling, the shell being coupled to the core with a plurality of fasteners attached to the shell, extending towards an interior of the shelter, and penetrating only an outer surface of the structural insulated panels that comprise the core such that the coupling is free of thermal transmission paths, and a movable portion interposed between the first end and the second end, comprising a plurality of structural insulated panels pivotably connected to the shell, the plurality of structural insulated panels that comprise the movable portion being movable between a stowed state and a deployed state.

18. The thermally isolated portable expandable shelter of claim 17, wherein the plurality of panels further comprises a ceiling panel, a first side wall panel, a second side wall panel, a floor panel, and a back wall panel coupled to the floor panel.

19. The thermally isolated portable expandable shelter of claim 17, wherein the coupling of the shell to the core is achieved with fasteners that extend less than all the way through the structural insulated panel that defines a floor.

20. The thermally isolated portable expandable shelter of claim 17, wherein the core further comprises mounting holes.

21. The thermally isolated portable expandable shelter of claim 20, wherein the mounting holes are substantially keyhole shaped.

22. The thermally isolated portable expandable shelter of claim 17, wherein the shell substantially corresponds in shape and size to an ISO shipping container.

* * * * *